United States Patent [19]

Bischof et al.

[11] Patent Number: 5,007,186

[45] Date of Patent: Apr. 16, 1991

[54] DEVICE FOR IMPROVING THE SEAL BETWEEN THE CUFF OF A SKI BOOT AND THE LEG

[75] Inventors: Horst Bischof, Graz; Wolfgang Skerbinjek, Baernbach, both of Austria

[73] Assignee: Koflach Sport Gesellschaft mbH & Co. KG, Voecklabruck, Austria

[21] Appl. No.: 279,064

[22] Filed: Dec. 2, 1988

[30] Foreign Application Priority Data

Dec. 7, 1987 [AT] Austria ..... 3219/87

[51] Int. Cl.[5] ..... A43B 5/04; A43B 11/00; A43C 11/00

[52] U.S. Cl. ..... 36/121; 36/117; 36/50; 24/68 SK

[58] Field of Search ..... 36/117–121, 36/50; 24/68 SK

[56] References Cited

U.S. PATENT DOCUMENTS

| | | | |
|---|---|---|---|
| 3,486,533 | 12/1969 | Doherty et al. | 138/147 |
| 4,155,377 | 5/1979 | Suzuki et al. | 138/149 |
| 4,280,286 | 7/1981 | Sartor | 36/118 |
| 4,345,430 | 8/1982 | Pallo et al. | 60/282 |
| 4,577,421 | 3/1986 | Sartor | 36/119 |
| 4,649,657 | 3/1987 | Iwama | 36/117 |
| 4,677,731 | 7/1987 | Sommerer et al. | 138/147 X |

FOREIGN PATENT DOCUMENTS

| | | | |
|---|---|---|---|
| 2732522 | 1/1978 | Fed. Rep. of Germany | 36/121 |
| 3431746 | 3/1985 | Fed. Rep. of Germany | 36/117 |

*Primary Examiner*—Paul T. Sewell
*Assistant Examiner*—Ted Kavanaugh
*Attorney, Agent, or Firm*—Peter E. Roseden

[57] ABSTRACT

In a device for improving the seal between the cuff (3) of a ski boot (1) or an inner (5) and the leg with a band (6) mounted on boot (1) or on inner (5), said band surrounding boot (1) and the leg and being closable beltwise, band (6) has at least one coupling member (13, 14) for optional mounting on cuff (3) or inner (5) of boot (1), said member being connectable with a matching computing member (11, 14) on cuff (3) or inner (5) of boot (1).

22 Claims, 2 Drawing Sheets

DEVICE FOR IMPROVING THE SEAL BETWEEN THE CUFF OF A SKI BOOT AND THE LEG

Figure 1:
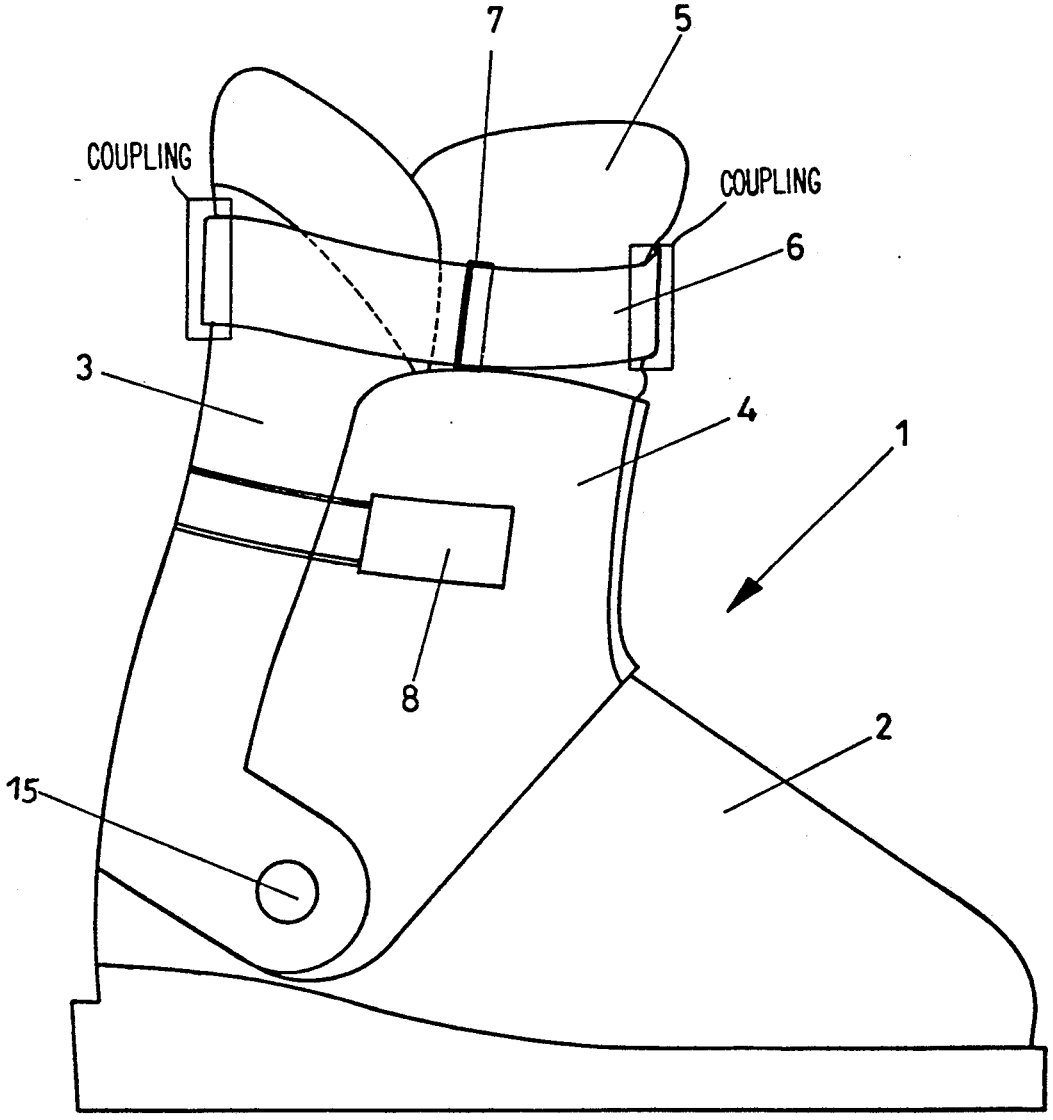

The invention relates to a device for improving the seal between the cuff of a ski boot or an inner (liner) and the leg, with a band attached to the boot or inner, said band surrounding the boot and leg and being closable like a belt.

Ski boots with a relatively hard shell usually have at least one soft cushioned inner, with a certain mobility of the foot inside the inner being provided, depending on the cushion thickness of said inner. The cuff of a ski boot, connected to a relatively rigid shell part, is usually connected to the shell by a joint to allow the leg to tilt into a forward position, with the tiltability of the cuff relative to the shell being limitable by suitable damping stops. In view of the cushioned design of the inner and the resultant mobility of the leg in said inner, the tight seal of the leg against the inner is not easily assured; the cushion is compressed unilaterally, especially when the leg tilts into a forward position. The maximum tilt of the cuff into a forward position can, as we have said, be limited by stops on the shell, and in known shell-type ski boots it is likewise conventional to limit the maximum tilt angle of the shaft relative to the shell at the back. With such a limitation of tilting movement, the material characteristics of the cuff additionally serve as a damper, since the support or limitation of the tilt angle does not occur near the upper seal of the cuff but rather near the connection of the cuff to the shell.

The goal of the invention is therefore to provide a device of the type recited hereinabove by which the tight seal of the inner relative to the foot is ensured in all tilting positions and by which an opportunity is optionally provided to utilize the damping properties of the material of the cuff in addition to the damped limitation of the tiltability of the cuff, without the tight seal of the leg relative to the inner being lost in the process. To achieve this goal, the invention essentially consists in the band having at least one coupling member for optional attachment to the cuff or inner of the ski boot, with the band being releasably connected to a matching coupling element on the cuff or inner of the boot. While in older inners the tight seal of the leg relative to the inner was ensured by a strap tightened at the instep, a band now surrounding the inner at the top edge ensures the seal near the upper edge of the inner independently of the compression of the cushion of the inner. To ensure correct positioning of the band surrounding the upper edge of the boot in these instances, the coupling element on the inner can be brought into an effective connection with the corresponding coupling member of the band, so that a tight seal of the inner to the leg regardless of the tilt position of the inner is ensured. If, as proposed by the invention, a coupling member can optionally be mounted not only on the inner but also possibly on the cuff as well, the band surrounding the inner like a belt encircles not only the inner but also the back part of the cuff, so that in this case the damping characteristics of the material of which the cuff is made become effective in limiting the tilt of the cuff into the forward position. Thus, by changing the point of attachment of the band by optional attachment of the coupling member to the cuff or inner, not only is the tight seal relative to the leg ensured, but by suitable choice of the attachment point, the damping of the limitation of the tilt of the cuff can be changed as well.

Advantageously, the design according to the invention is such that the coupling members are formed by snaps, hook and loop fasteners, openings and pins or the like, with the coupling members preferably being designed differently for different mounting positions. For the secure fastening of the band to the cuff, especially the exterior of said cuff, the design can be made simply such that the coupling member for mounting on the exterior of the cuff is formed by a pin connectable with the cuff, said pin engaging a hole in the band; in this connection, a different design of the coupling member for mounting on the inner is especially important, mainly because pressure points in the inner of the boot are eliminated in this manner. The attachment of the band to the inner can be designed in an especially simple fashion as a hook and loop fastener, with the coupling members of parts cooperating with one another consisting of hook and loop fasteners such that the resultant coupling of the band to the inner is especially flat in design and distributes pressure over a wide area. In the case of mounting on the exterior of the boot, an especially secure attachment to the cuff, and one that can also absorb great forces, can be achieved with a coupling element unlike a hook and loop fastener of this type, especially with the preferred pin. Of course, a snap can also be used on the exterior as a coupling member. To ensure correct positioning of the closing members for the band at any coupling position, optionally on the cuff or on the inner, the design is advantageously made such that the coupling members mounted on the cuff or inner are each located externally approximately midway along the length of the boot at the back of the cuff or inner.

To protect the coupling members from damage, the design can advantageously be made such that the pin of the cuff is overlapped by a loop releasably attachable to the cuff. In an especially simple fashion, according to a preferred embodiment, the pin can be made integral with the loop. The suspension or mounting of the loop on the cuff can be accomplished for example by angled engaging slots, with the loops being insertable into the slots by elastic deformation.

By connecting the bands of two boots, a carrying device for ski boots can also be formed in simple fashion.

The invention will now be described in greater detail with reference to one embodiment shown in the drawing.

Figure 2:
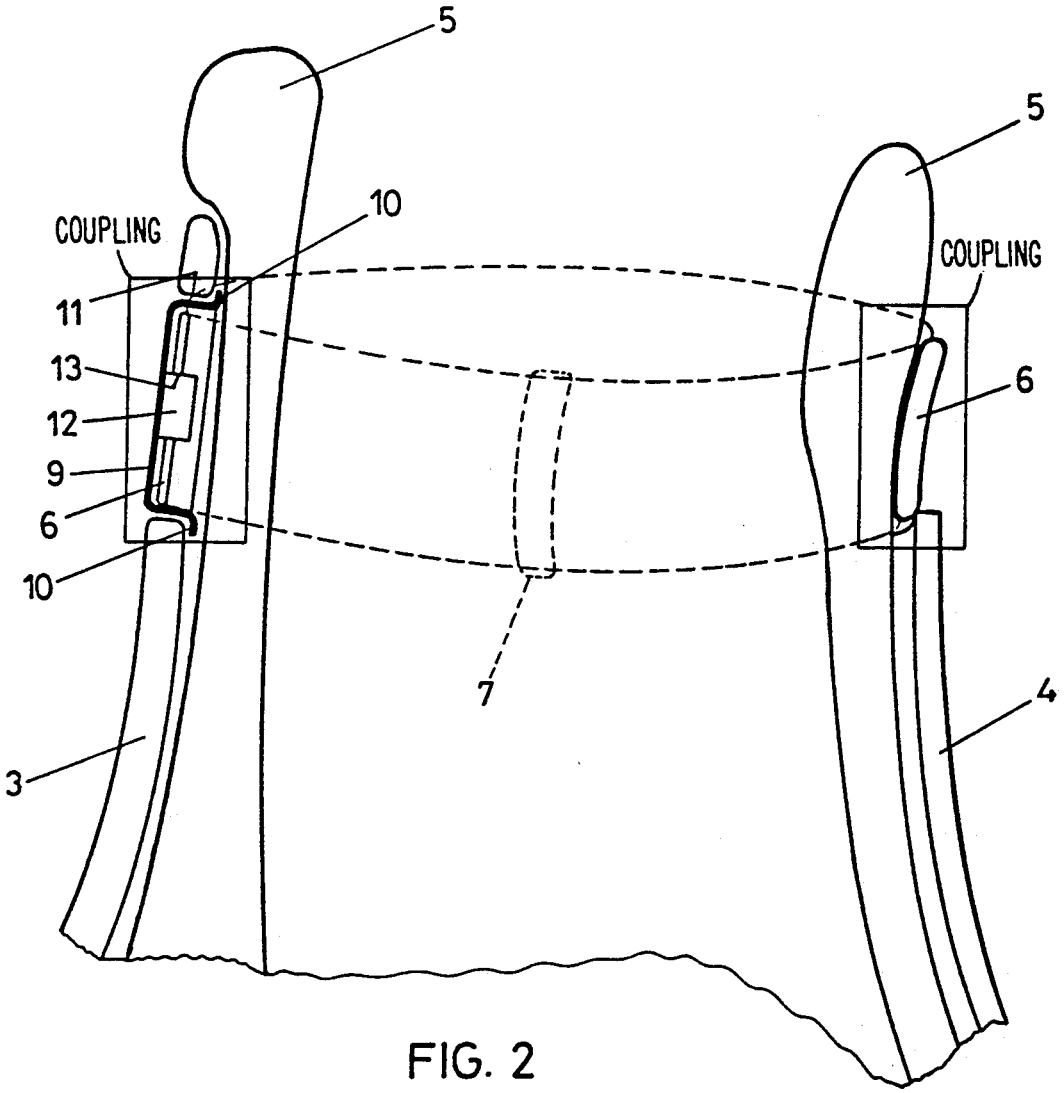
Figure 3:
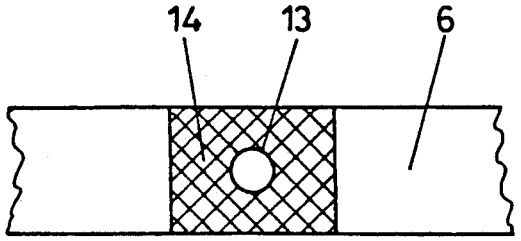

FIG. 1 is a schematic side view of a cuff, with the device according to the invention on the back of said cuff, while FIG. 2 shows a section through the lengthwise central plane of the cuff, enlarged, with a modified device, and FIG. 3 shows a partial area of the band looking at its inner side.

The drawing shows a ski boot 1 comprising a shell 2 and a cuff composed of two parts 3 and 4, with cuff part 3 provided in the back area being unfoldable rearward in the embodiment shown. An inner 5 is shown schematically inside boot 1. The two cuff parts 3 and 4 are tiltable relative to shell 2 around a pivot axis indicated by 15 and located in the vicinity of the ankle bone. As shown clearly in FIG. 1, the part 4 of the cuff facing the toe of the boot is lower than back part 3. To prevent gapping in the back area when tilting forward, in the drawing in FIG. 1 a band 6 is mounted on the exterior of cuff part 3, said band surrounding back part 3 and inner 5 in its upper area. In simple fashion, band 6 is attached for example by a hook and loop fastener to cuff part 3. To vary the length of the band, the latter has for example an eye 7 in which the band is reversed, so that a reliable seal of the desired length is made possible by providing a hook and loop fastener for example. In FIG. 1, a toggle buckle 8 is shown schematically in the vicinity of the cuff as a closure for the ski boot.

In the drawing in FIG. 2, band 6 provided according to the invention is mounted on cuff part 3. In this embodiment band 6 is attached by a loop 9 which has projections 10 that engage recesses 11 provided in cuff part 3, with band 6 being positioned over a pin provided on loop 9, said pin projecting through an opening 13 in band 6.

FIG. 3 shows a partial area of band 6, with FIG. 3 being a view of the inner side of this band. Band 6 has opening 13 to receive pin 12, with opening 13 being surrounded on the inside by a portion of a hook and loop fastener 14 which can be connected to a matching complementary part of the hook and loop fastener on the exterior of inner 5.

We claim:

1. In a ski boot having at least one movable cuff part and an opposing inner liner, an improvement in the seal between the boot and a user's leg when the boot is closed around the user's leg, comprising the combination of:

band means for encircling one movable cuff part and the inner liner of the boot and for providing an adjustable closing seal between said movable cuff part, the inner liner and the leg; and at least one coupling means mounted on the boot for releasably attaching said band means to the boot wherein said coupling means is optionally attached at said movable cuff part or at said inner liner at a point approximately on the longitudinal central axis of the boot on the external surface of said inner liner or at both said locations and wherein the coupling means mounted onto said movable cuff part is designed differently from the coupling means mounted on said inner liner so as to provide varying, selectable mounting positions of said band onto said coupling means.

2. In a ski boot having at least one movable cuff part and an opposing inner liner, an improvement in the seal between the boot and a user's leg when the boot is closed around the user's leg, comprising the combination of:

band means for encircling one movable cuff part and the inner liner of the boot and for providing an adjustable closing seal between said movable cuff part, the inner liner and the leg; and coupling means mounted on the boot for releasably attaching said band means to the boot wherein one said coupling means is mounted on the external surface of said movable cuff part approximately on the longitudinal central axis of the boot and a second coupling means is mounted on the external surface of said inner liner approximately on the longitudinal central axis of the boot.

3. In a ski boot having a forward cuff part, a rearward cuff part and an inner liner located opposite the rearward cuff part, an improvement in the seal between the boot and a user's leg when the boot is closed around the user's leg, comprising the combination of:

band means for encircling the rearward cuff part and the inner liner of the boot and for providing an adjustable closing seal between the rearward cuff part, the inner liner and the leg; and coupling means mounted on the external surface of the boot approximately on its longitudinal central axis on both said rearward cuff part and said inner liner for releasably attaching said band means to the boot, wherein the coupling means mounted on said rearward cuff part is designed differently from the coupling means mounted on said inner liner so as to allow optional and varying attachment positions of said band means to the boot.

4. The combination of claim 2, wherein one of said coupling means is formed from snaps.

5. The combination of claim 1, wherein one of said coupling means is formed from snaps.

6. The combination of claim 1, wherein one of said coupling means is formed from hook and loop fasteners.

7. The combination of claim 1, wherein one of said coupling means is formed from pins fitted through openings.

8. The combination of claim 1, wherein one said coupling means is mounted on the external surface of said movable cuff part approximately on the longitudinal central axis of the boot.

9. The combination of claim 1, wherein one said coupling means is comprised of a pin connectable with said movable cuff part, said pin further engaging an opening in said band means.

10. The combination of claim 9, wherein said pin is overlapped by a loop which is releasably mounted on said movable cuff part.

11. The combination of claim 10, wherein said pin is formed as an integral part of said loop.

12. The combination of claim 3, wherein one of said coupling means is comprised of a pin connectable with the rearward cuff part, said pin further engaging an opening in said band means.

13. The combination of claim 12, wherein said pin is overlapped by a loop which is releasably mounted on the rearward cuff part.

14. The combination of claim 13, wherein said pin is formed as an integral part of said loop.

15. The combination of claim 2, wherein one of said coupling means is formed from hook and loop fasteners.

16. The combination of claim 2, wherein one of said coupling means is formed from pins fitted through openings.

17. The combination of claim 2, wherein said one coupling means is comprised of a pin connectable with said movable cuff part, said pin further engaging an opening in said band means.

18. The combination of claim 17, wherein said pin is overlapped by a loop which is releasably mounted on said movable cuff part.

19. The combination of claim 18, wherein said pin is formed as an integral part of said loop.

20. The combination of claim 3, wherein one of said coupling means is comprised of a pin connectable with the rearward cuff part, said pin further engaging an opening in said band means.

21. The combination of claim 20, wherein said pin is overlapped by a loop which is releasably mounted on the rearward cuff part.

22. The combination of claim 21, wherein said pin is formed as an integral part of said loop.

* * * * *